US009837767B2

(12) United States Patent
Fransen et al.

(10) Patent No.: US 9,837,767 B2
(45) Date of Patent: Dec. 5, 2017

(54) COMMUNICATION CONNECTOR HAVING A PLURALITY OF CONDUCTORS WITH A COUPLING ZONE

(71) Applicant: Panduit Corp., Tinley Park, IL (US)

(72) Inventors: Robert E. Fransen, Tinley Park, IL (US); Louann M. Devine, Des Plaines, IL (US); Frank M. Straka, Chicago, IL (US)

(73) Assignee: Panduit Corp., Tinley Park, IL (US)

( * ) Notice: Subject to any disclaimer, the term of this patent is extended or adjusted under 35 U.S.C. 154(b) by 384 days.

(21) Appl. No.: 14/334,041

(22) Filed: Jul. 17, 2014

(65) Prior Publication Data

US 2014/0345129 A1 Nov. 27, 2014

Related U.S. Application Data

(63) Continuation of application No. 13/611,712, filed on Sep. 12, 2012, now Pat. No. 8,801,473.

(51) Int. Cl.

| | |
|---|---|
| ***H01R 13/6467*** | (2011.01) |
| ***H01R 43/20*** | (2006.01) |
| ***H01R 43/26*** | (2006.01) |
| ***H01R 24/64*** | (2011.01) |

(52) U.S. Cl.

CPC ..... *H01R 13/6467* (2013.01); *H01R 43/20* (2013.01); *H01R 43/26* (2013.01); *H01R 24/64* (2013.01); *Y10T 29/49204* (2015.01)

(58) Field of Classification Search

CPC ..... H01R 24/64; H01R 43/20; H01R 13/6467
USPC ..... 439/676
See application file for complete search history.

(56) References Cited

U.S. PATENT DOCUMENTS

| | | | | |
|---|---|---|---|---|
| 5,547,405 | A * | 8/1996 | Pinney | H01R 13/6625 439/676 |
| 5,779,503 | A | 7/1998 | Tremblay et al. | |
| 5,975,936 | A | 11/1999 | Lin et al. | |
| 5,989,071 | A | 11/1999 | Larsen et al. | |
| 6,080,007 | A | 6/2000 | Dupuis et al. | |
| 6,099,357 | A | 8/2000 | Reichle | |
| 6,186,834 | B1 | 2/2001 | Arnett et al. | |
| 6,375,491 | B1 | 4/2002 | Durand et al. | |
| 6,612,877 | B2 | 9/2003 | Hyland | |
| 6,964,587 | B2 | 11/2005 | Colantuono et al. | |
| 7,048,590 | B2 | 5/2006 | Colantuono et al. | |
| 7,066,764 | B2 | 6/2006 | Bolouri-Saransar | |

(Continued)

FOREIGN PATENT DOCUMENTS

DE WO 0243187 A1 * 5/2002 ..... H01R 4/2433

*Primary Examiner* — Livius R Cazan
(74) *Attorney, Agent, or Firm* — Christopher S. Clancy; James H. Williams; Ryan K. Thelen

(57) ABSTRACT

A communication connector including a plurality of conductors each having a plug contact region and an opposing cable conductor termination region. The plurality of conductors are arranged in respective communication pairs. The communication connector includes a coupling zone between a first conductor of a first communication pair and a second conductor of a second communication pair. The coupling zone has at least one first conductive finger connected to the first conductor and at least one second conductive finger connected to the second conductor, each of the first conductive fingers are adjacent to at least one of the second conductive fingers.

5 Claims, 18 Drawing Sheets

(56) References Cited

U.S. PATENT DOCUMENTS

| | | | | |
|---|---|---|---|---|
| 7,086,909 | B2 | 8/2006 | Colantuono et al. | |
| 7,168,993 | B2 | 1/2007 | Hashim | |
| 7,186,148 | B2 | 3/2007 | Hashim | |
| 7,186,149 | B2 | 3/2007 | Hashim | |
| 7,201,618 | B2 | 4/2007 | Ellis et al. | |
| 7,204,722 | B2 | 4/2007 | Hashim et al. | |
| 7,314,393 | B2 | 1/2008 | Hashim | |
| 7,320,624 | B2 | 1/2008 | Hashim et al. | |
| 7,341,493 | B2 | 3/2008 | Pepe et al. | |
| 7,481,678 | B2 * | 1/2009 | Aekins ..... | H01R 13/7033 439/620.11 |
| 7,686,650 | B2 | 3/2010 | Belopolsky et al. | |
| 7,736,195 | B1 | 6/2010 | Poulsen et al. | |
| 7,819,703 | B1 | 10/2010 | Walker et al. | |
| 7,927,152 | B2 | 4/2011 | Pepe et al. | |
| 8,007,311 | B2 | 8/2011 | Hogue et al. | |
| 8,070,531 | B1 | 12/2011 | Ku et al. | |
| 2002/0019172 | A1 | 2/2002 | Forbes et al. | |

* cited by examiner

COMMUNICATION CONNECTOR HAVING A PLURALITY OF CONDUCTORS WITH A COUPLING ZONE

CROSS-REFERENCE TO RELATED APPLICATION

This application is a continuation of U.S. patent application Ser. No. 13/611,712, filed Sep. 12, 2012, now U.S. Pat. No. 8,801,473, the subject matter of which is hereby incorporated by reference in its entirety

TECHNICAL FIELD

The present invention relates to the field of network communication jacks and, more specifically, to lead frame style modular network communication jacks.

BACKGROUND

As the market for structured cabling and connectivity matures different connectivity products become more commoditized and therefore more sensitive to cost. With regard to communication jacks, one relatively low cost solution is a lead frame style jack having eight metal contacts within the jack corresponding to the 1-8 individual conductors making up four differential pairs. These eight metal contacts form plug interface contacts (PICs), insulation displacement contact terminals (typically insulation displacement contacts (IDCs)), and a connection section extending between the PICs and the IDCs. Such construction is often accomplished by using continuous metal leads extending from the PICs to the IDCs. Furthermore, in certain applications these same contacts can be used to compensate for unwanted crosstalk. Suitable crosstalk compensation interactions can be created between lead pairs by forming a section of one lead of a lead pair in near proximity to a section of another appropriate lead of another lead pair. Such design can eliminate the need for a circuit board within the jack with equivalent compensation elements. By obviating the need for a circuit board, jack manufacturing time and material costs may be reduced.

However, notwithstanding the omission of a circuit board, other factors can influence the cost and complexity of a network jack. These can include the total number of sections where contacts must cross over one another, the materials used to coat the metal contacts, and the number of contact stamping reels needed for manufacture. Furthermore, these factors can become more significant in their importance as the jacks are manufactured to higher performance standards such as Category 6 (CAT 6) (250 MHz), Augmented Category 6 (CAT 6a) (500 MHz), and higher. Therefore, there is a need for a lead frame communication jack capable of high frequency electrical performance, such as for example CAT6 performance, while maintaining the inherent cost benefits of a lead frame jack design.

BRIEF DESCRIPTION OF FIGURES

The features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION

Figure 1:
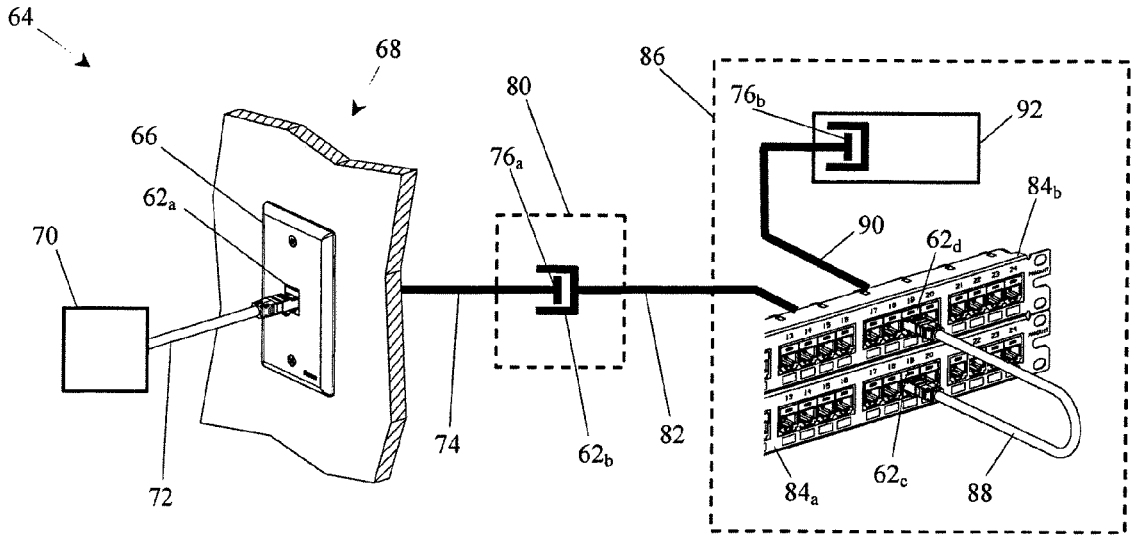
FIG. 1 is a schematic view of a communication system according to an embodiment of the present invention.

Referring now to the drawings, and more particularly to FIG. 1, there is shown a communication system 64 including communication jack $\mathbf{62}_a$ installed to faceplate 66 at work station system 68. Device 70 is connected to communication jack $\mathbf{62}_a$ by networking patch cord 72. Device 70 may include, but is not limited to, a computer, telephone, printer, fax machine, gaming system, router, etc. Communication jack $\mathbf{62}_a$ is terminated to zone cable 74. The opposite end of zone cable 74 is terminated with a RJ45 plug $\mathbf{76}_a$ (shown schematically in FIG. 1). RJ45 plug $\mathbf{76}_a$ is plugged into communication jack $\mathbf{62}_b$ (shown schematically), which is located within distribution zone enclosure 80. Horizontal cable 82 is terminated on one end to jack $\mathbf{62}_b$ and is terminated to jack $\mathbf{62}_c$ at the opposite end. Jack $\mathbf{62}_c$ is installed in patch panel $\mathbf{84}_a$ inside of telecommunication closet 86. RJ45 patch cord 88 connects jack $\mathbf{62}_c$ to jack $\mathbf{62}_d$, which is installed in patch panel $\mathbf{84}_b$. Network cable 90 is terminated to jack $\mathbf{62}_d$ on one end, and RJ45 plug $\mathbf{76}_b$ on the opposite end. RJ45 plug $\mathbf{76}_b$ connects to networking device 92. Networking device 92 may include, but is not limited to, a switch, router, server, etc. Channel system 64 is just one non-limiting example of an enterprise space four connector channel configuration using four communication jacks 62. In other embodiments, the present invention is compatible with other channel configurations, including channels that occupy space within a datacenter.

Figure 2:
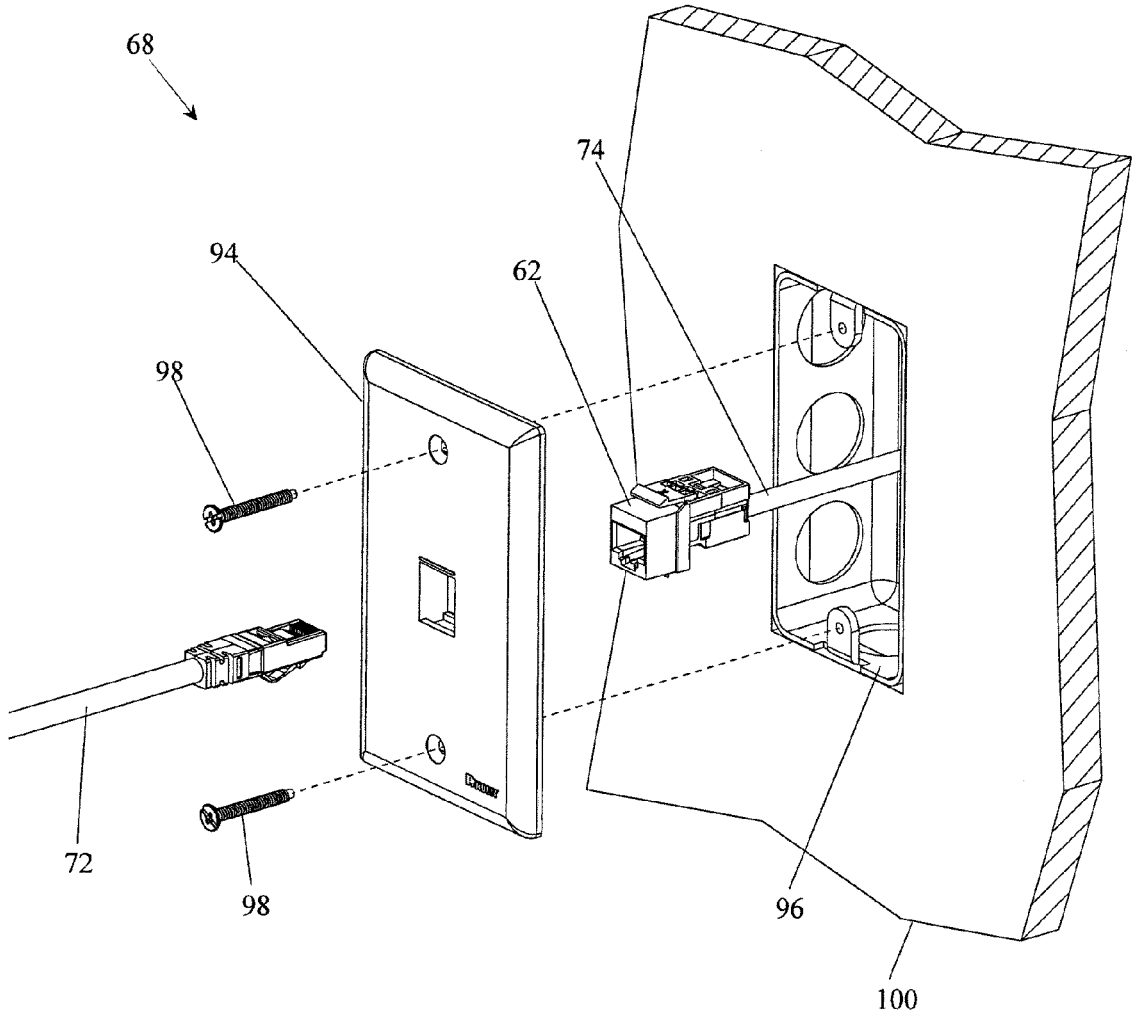
FIG. 2 is an exploded perspective view of a work station system according to an embodiment of the present invention.

A fragmentary exploded view of work station system 68 is shown in FIG. 2. Communication jack 62 is terminated to zone cable 74 and is assembled to faceplate 94. Faceplate 94 mounts to electrical box 96 by two screws 98. Electrical box 96 is mounted to wall 100.

Figure 3:
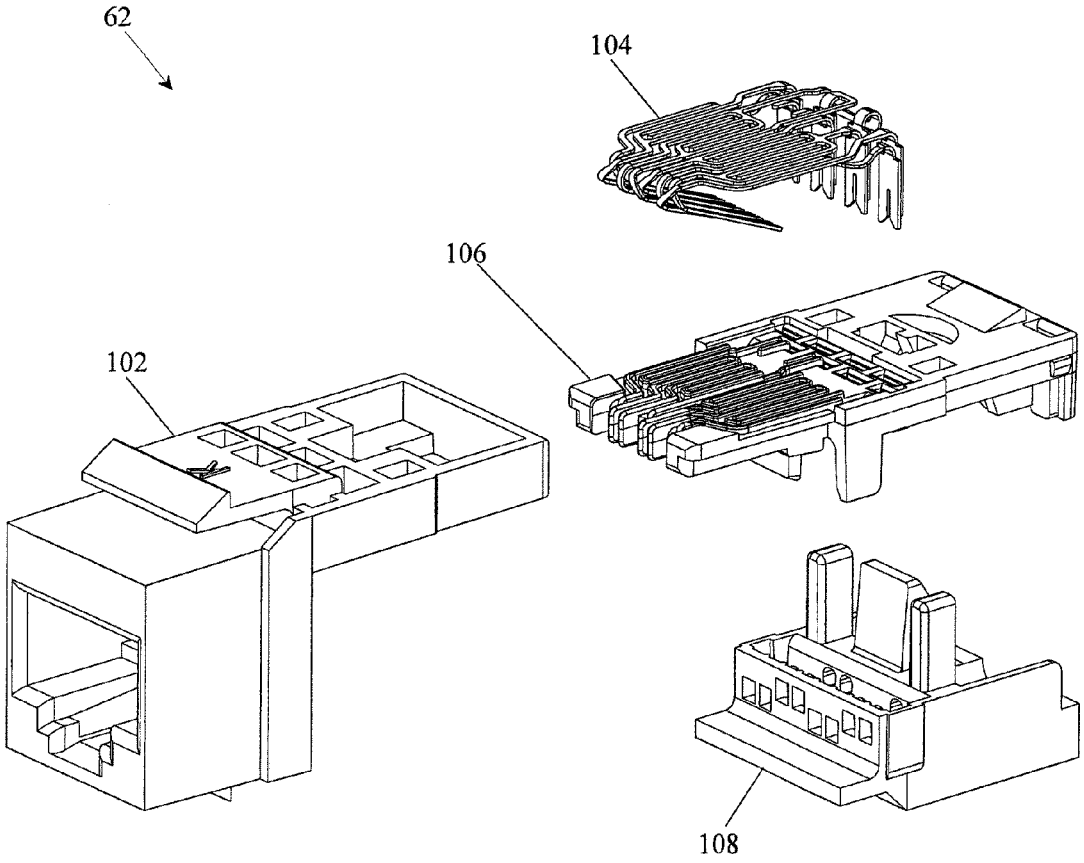
FIG. 3 is an exploded perspective view of a jack according to an embodiment of the present invention.
Figure 4:
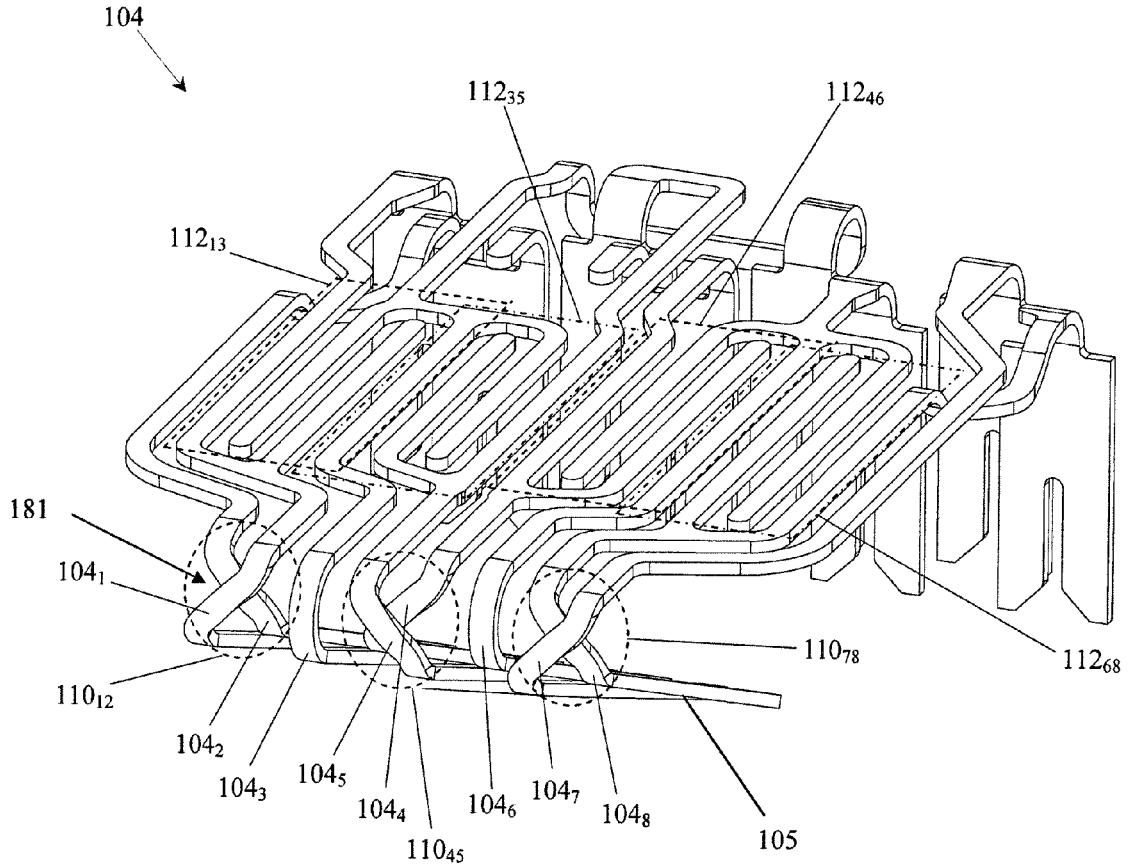
FIG. 4 is a perspective view of the jack contacts of FIG. 3.
Figure 5:
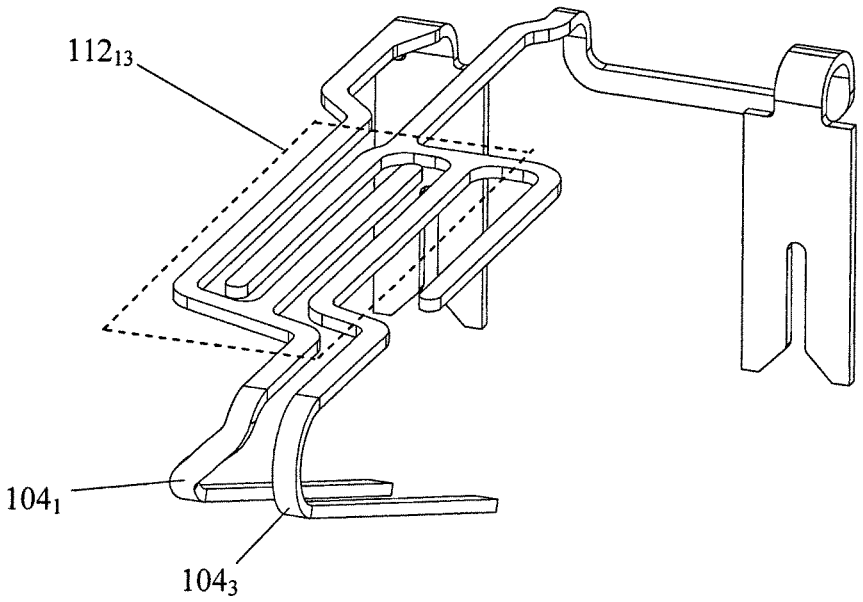
FIG. 5 is a perspective view of a first subset of the jack contacts of FIG. 4 illustrating a first capacitive region or zone.
Figure 6:
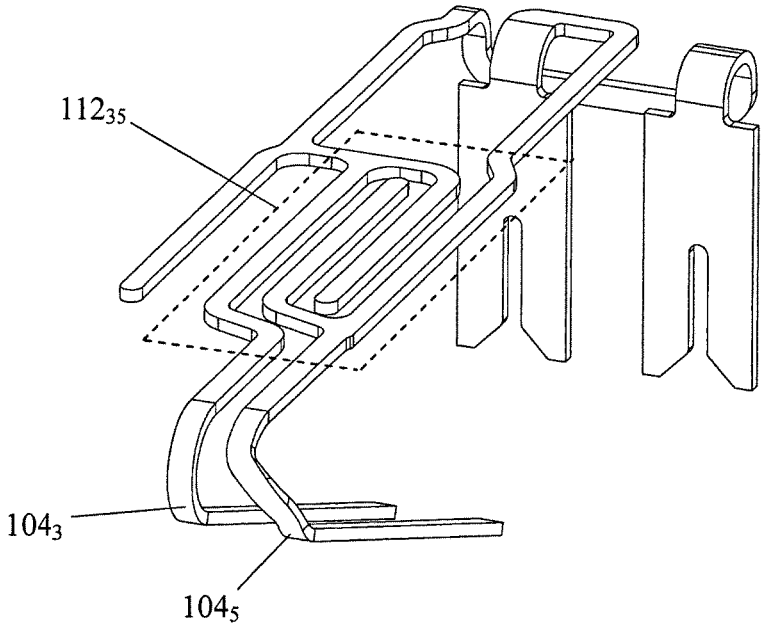
FIG. 6 is a perspective view of a second subset of the jack contacts of FIG. 4 illustrating a second capacitive region or zone.
Figure 7:
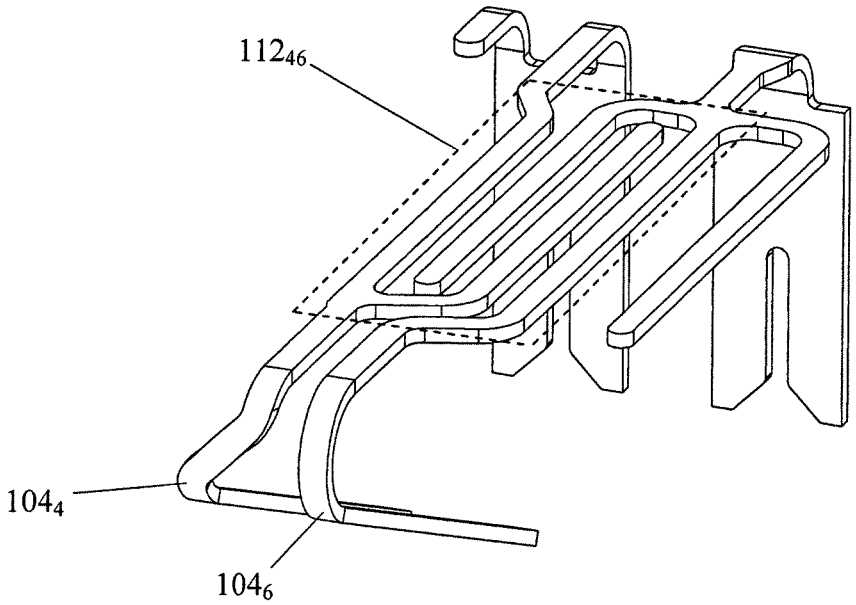
FIG. 7 is a perspective view of a third subset of the jack contacts of FIG. 4 illustrating a third capacitive region or zone.
Figure 8:
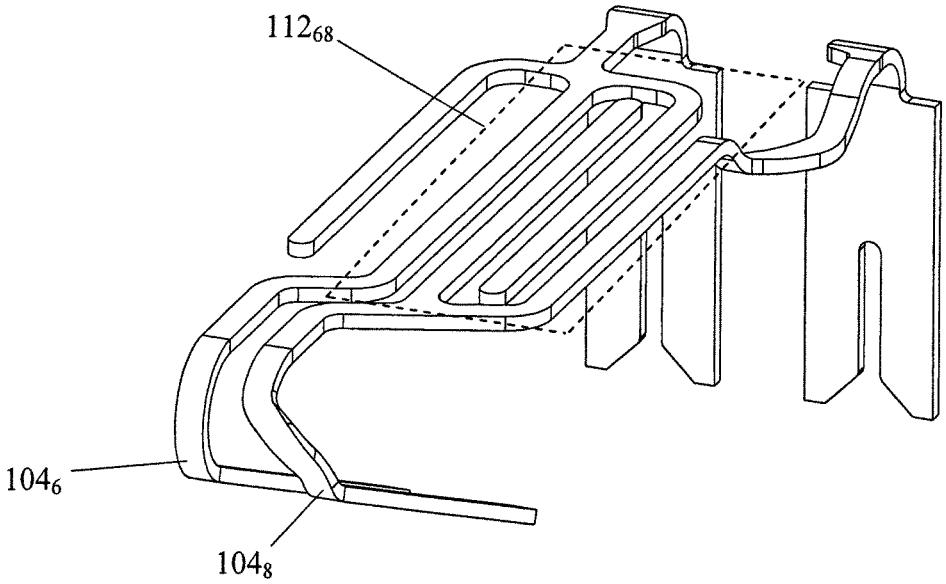
FIG. 8 is a perspective view of a fourth subset of the jack contacts of FIG. 4 illustrating a fourth capacitive region or zone.

Referring to the drawings in more detail, FIG. 3 shows one embodiment of the present invention. In this embodiment, jack 62 includes a housing 102, contacts 104, a support sled 106, and a wire cap 108. Contacts 104 include individual contacts $\mathbf{104}_1$-$\mathbf{104}_8$ which correspond to the 1-8 individual wires that typically connect to and make up the 4 differential pairs of an RJ45 jack. A magnified view of contacts 104, according to one embodiment of the present invention, is shown in FIG. 4, with contact subsets shown in FIGS. 5-8. Initial crossover regions $\mathbf{110}_{12}$, $\mathbf{110}_{45}$, and $\mathbf{110}_{78}$ respectively correspond to the regions where contact $\mathbf{104}_1$ crosses over contact $\mathbf{104}_2$, contact $\mathbf{104}_5$ crosses over contact $\mathbf{104}_4$, and contact $\mathbf{104}_7$ crosses over contact $\mathbf{104}_8$, wherein each crossover occurs at particular crossover points 181. An earlier crossover of contacts 104, with respect to the distance from the PICs, may be advantageous because 1) it may reduce the relative amount of initial offending crosstalk at the PICs and plug contacts region; 2) it may increase the effective length of the compensation zone, allowing for more degrees of freedom relative to the coupling structures in the compensation zone; 3) it may brings the compensation zone closer to the point of contact between the plug contacts and the PICs; and 4) it may allow for greater turning. Note that the compensation zone may extend between and including the crossover points 181 and the IDCs.

Preferably, the crossover regions 110 generally exist where contacts 104 bend around the front of the support sled 106. More preferably, the particular crossover points 181 occur approximately at the apex of the bends of the contacts 104. In one embodiment, the distance from the point of contact 105 of the plug contacts to the apex of the bends of contacts $\mathbf{104}_2$, $\mathbf{104}_4$, $\mathbf{104}_6$, and $\mathbf{104}_8$ is approximately 0.250 inches; and the distance from the point of contact 105 of the plug contacts to the apex of the bends of contacts $\mathbf{104}_1$, $\mathbf{104}_3$, $\mathbf{104}_5$, and $\mathbf{104}_7$ is approximately 0.290 inches. In another embodiment, the distance from the point of contact 105 of the plug contacts to the apex of the bends of contacts 104 ranges from 0.230 to 0.310 inches. The point of contact 105 of the plug contacts varies depending on the design of certain features of the jack and/or plug, but for a given design will have a predetermined position.

To reduce the near end crosstalk (NEXT) effects and obtain CAT6 or higher performance, it is desirable that there be sufficient amount of coupling (primarily capacitive, and also inductive coupling) among certain pairs of contacts. These pairs are commonly referred to as X:Y pairs, wherein the X and the Y denote individual contact number. For example, contact pair 3:6 refers to a pair of $\mathbf{104}_3$ and $\mathbf{104}_6$ contacts. Typically, to reduce NEXT, the necessary coupling occurs between the 1:3, 3:5, 4:6, and 6:8 contact pairs.

In the embodiment shown in FIGS. 4-8, contacts $\mathbf{104}_8$, $\mathbf{104}_6$, $\mathbf{104}_5$, $\mathbf{104}_4$, $\mathbf{104}_3$, and $\mathbf{104}_1$ are effectively coupled in regions 112 in a specific manner. This configuration may achieve CAT6 performance on all contact pairs. In particular, the total length of each contact and their proximity with respect to one another in the compensation zone allows: contact $\mathbf{104}_8$ to couple to contact $\mathbf{104}_6$ in zone $\mathbf{112}_{68}$ (C68); contact $\mathbf{104}_3$ to couple to contact $\mathbf{104}_5$ in zone $\mathbf{112}_{35}$ (C35); contact $\mathbf{104}_1$ to couple to contact $\mathbf{104}_3$ in zone $\mathbf{112}_{13}$ (C13); and contact $\mathbf{104}_4$ to couple to contact $\mathbf{104}_6$ in zone $\mathbf{112}_{46}$ (C46). All four of the coupling regions are shown together in FIG. 4, and individually in FIGS. 5-8.

Figure 9:
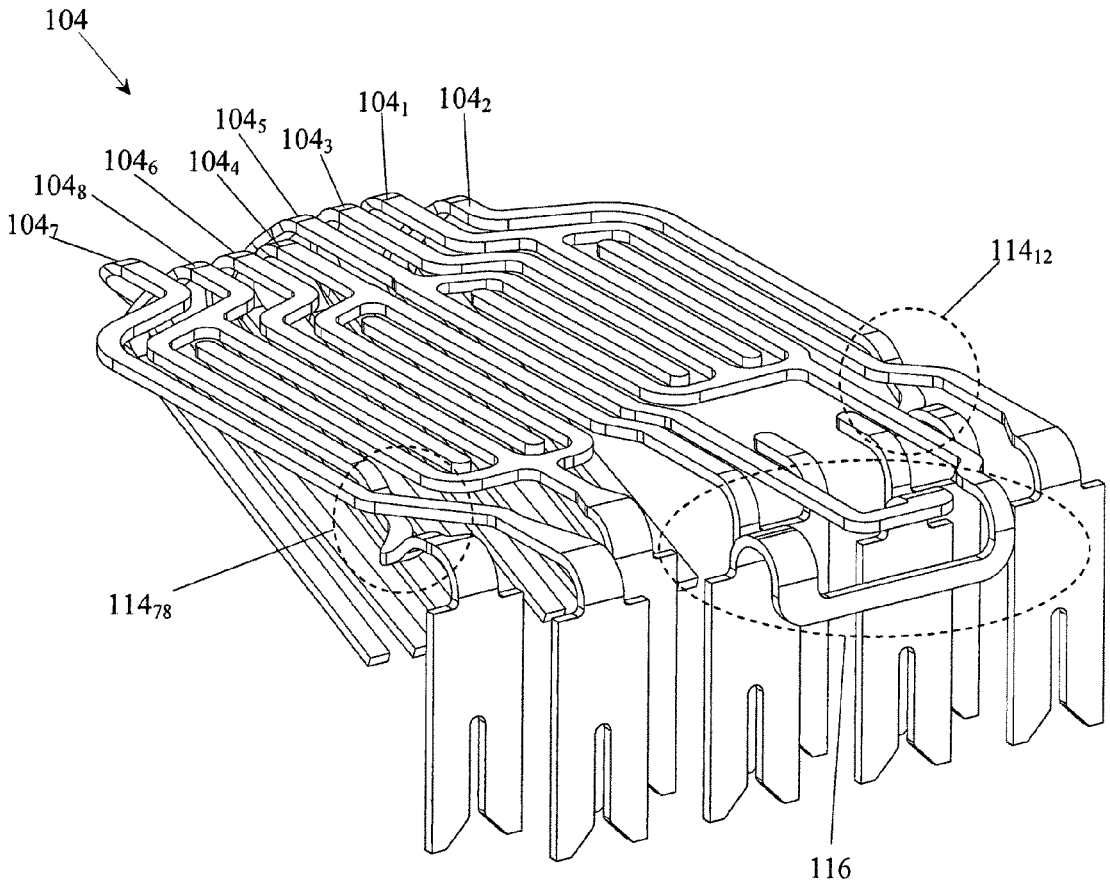
FIG. 9 is a perspective view of the jack contacts of FIG. 4 as viewed from the IDC end of the contacts.

With respect to the coupling regions 112, desired capacitance may be attained because of the long interlocking finger-like nature of the design with both the metal contacts and plastic dielectric of the support sled 106 being interwoven together to increase the effective capacitance. A reverse isometric view of contacts 104 is shown in FIG. 9 which illustrates secondary crossover regions $\mathbf{114}_{12}$ and $\mathbf{114}_{78}$ for contact pairs 1:2 and 7:8, respectively. These crossover regions can be used for further tuning of the jack, such as for example, NEXT tuning. Placement of the crossover regions $\mathbf{114}_{12}$ and $\mathbf{114}_{78}$ can vary and can impact relative magnitude of compensation and/or crosstalk to reach the desired electrical performance. In the illustrated embodiment, contact pair 3:6 does not require a crossover in region 110 or 114 since contact $\mathbf{104}_3$ wraps around contacts $\mathbf{104}_4$ and $\mathbf{104}_5$ in region 116, minimizing or eliminating the need for any crossover in contact pair 3:6.

Figure 10:
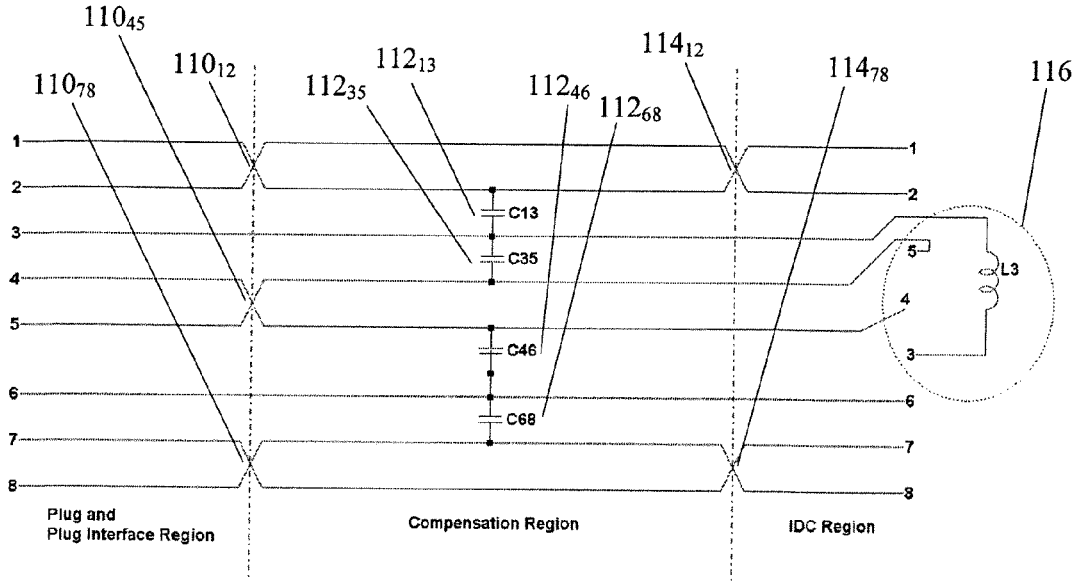
FIG. 10 is a schematic of the jack contacts of FIG. 4 according to an embodiment of the present invention.

In certain designs, coupling occurring in the IDC region between contact pairs 3:4 and 5:6 may be a significant source of crosstalk. Contact $\mathbf{104}_3$'s wrap-around in the IDC region (represented by self-inductance L3 in FIG. 10) enables contact $\mathbf{104}_3$ to be adjacent to contact $\mathbf{104}_6$ and eliminates the 3:6 split contact pair around the 4:5 contact pair in the IDC area and wire cap 108. The layout of the presently described embodiment has crosstalk in region 116 primarily between 3:4 and not 5:6 contact pairs. This is shown in FIGS. 9 and 10.

Turning to individual contact pair combinations, for contact pair combinations 3:6-7:8 and 3:6-1:2, crossover regions $\mathbf{110}_{12}$ and $\mathbf{110}_{78}$ include contacts $\mathbf{104}_1$, $\mathbf{104}_2$, $\mathbf{104}_7$, and $\mathbf{104}_8$; and crossover regions $\mathbf{114}_{12}$ and $\mathbf{114}_{78}$ include contacts $\mathbf{104}_1$, $\mathbf{104}_2$, $\mathbf{104}_7$, and $\mathbf{104}_8$. Referring to contact pair combination 3:6-7:8, crossover in region $\mathbf{110}_{78}$ enables contacts $\mathbf{104}_6$ and $\mathbf{104}_8$ to be within close proximity of each other and be coupled in the coupling region for compensation, followed by the crossover in region $114_{78}$. Similarly, for contact pair combination 3:6-1:2, crossover in region $110_{12}$ enables contacts $104_3$ and $104_1$ to be within close proximity of each other and be coupled in the coupling region for compensation, followed by the crossover in region $114_{12}$.

Figure 11:
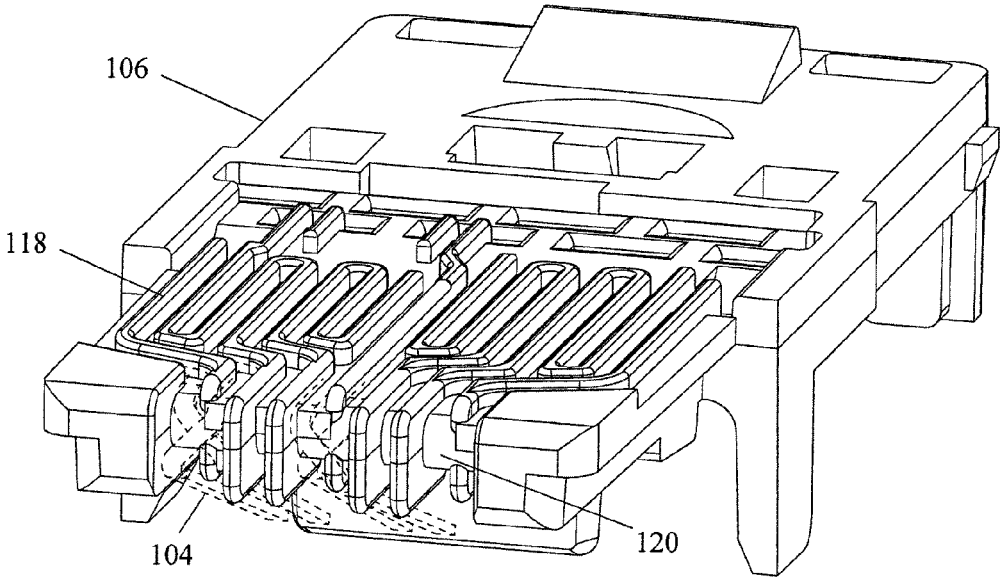
FIG. 11 is a perspective view of the support sled of FIG. 3.

Turning to FIG. 11, support sled 106 preferably includes rib elements 118 that maintain separation between contacts 104 in the jack's assembled state. Rib elements 118 reduce the risk of electrical shorts and high potential failures while at the same time controlling the dielectric between contacts 104 to control the magnitude of capacitance between the various contacts. Additional features which may reduce the risk of electrical shorts and high potential failures at or around the crossover regions 110 are disclosed in another embodiment discussed below. Fragmentary contacts 104 are shown as hidden lines to illustrate the initial crossover regions 110 as they bend around mandrel 120 of support sled 106.

Figure 12:
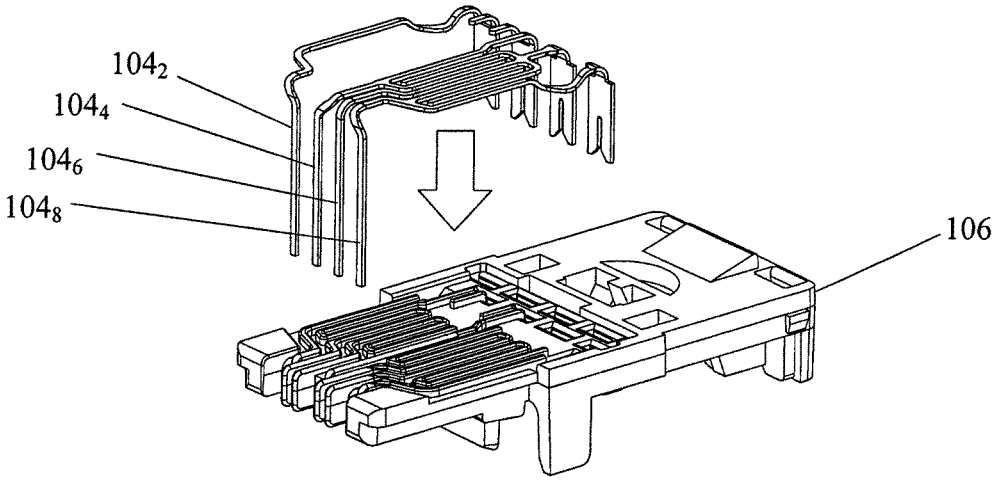
FIGS. 12-17 are perspective views of assembly steps of contacts and support sled according to an embodiment of the present invention.
Figure 13:
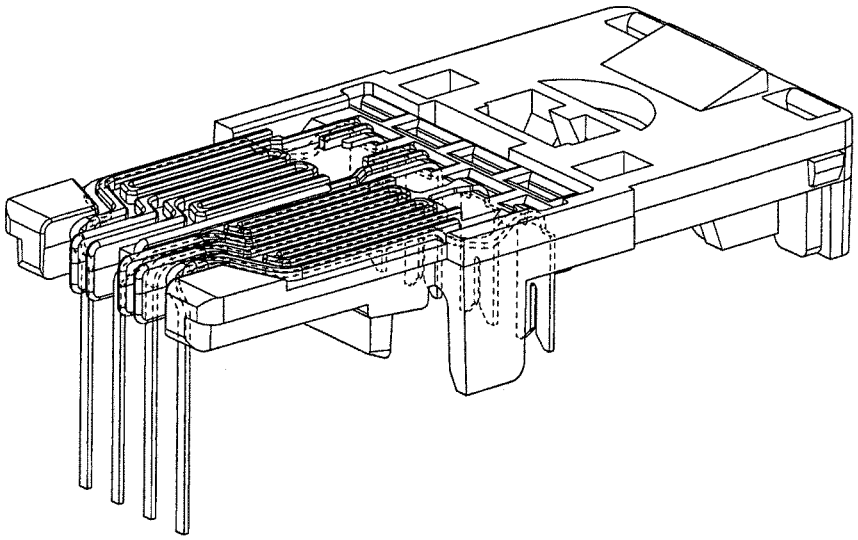
Figure 14:
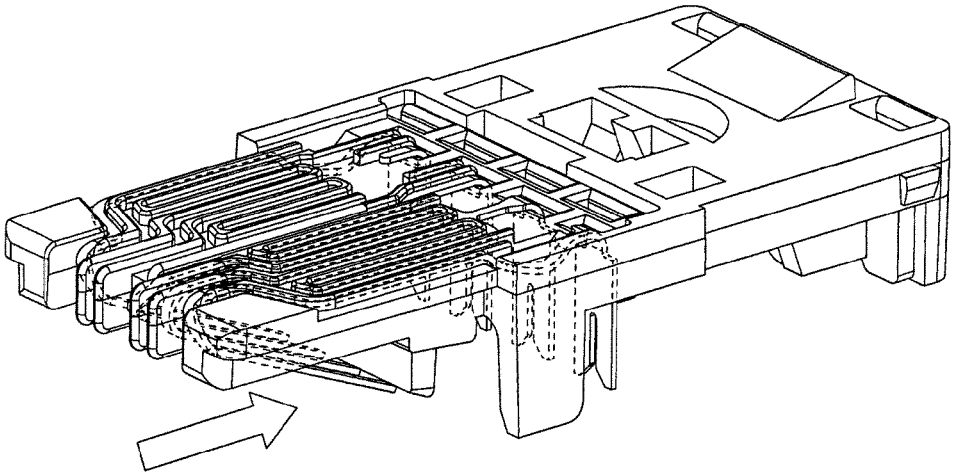
Figure 15:
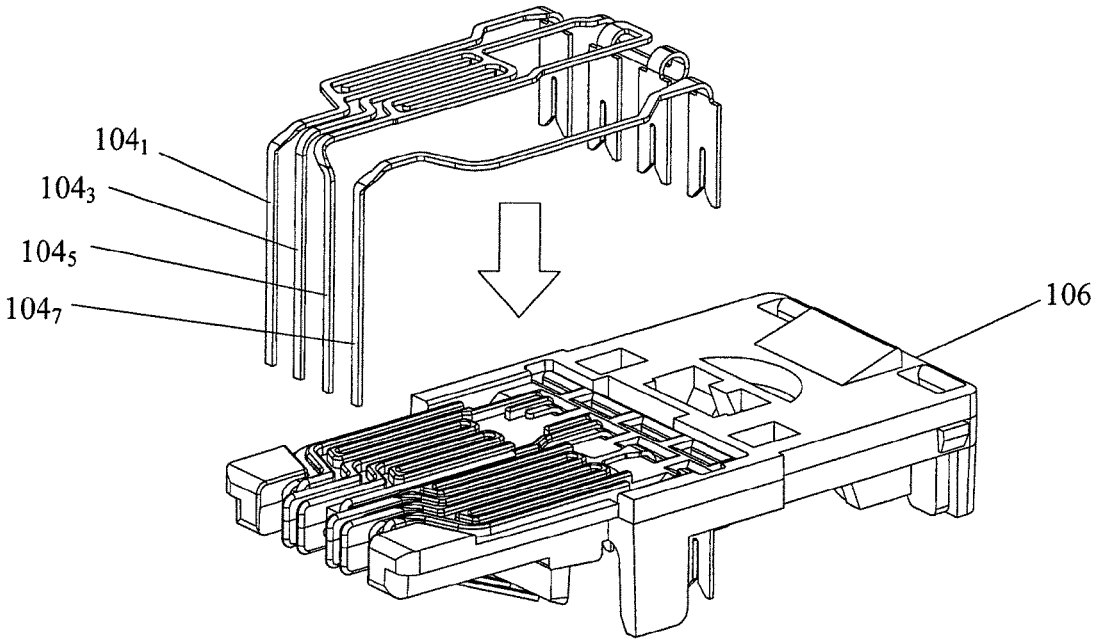
Figure 16:
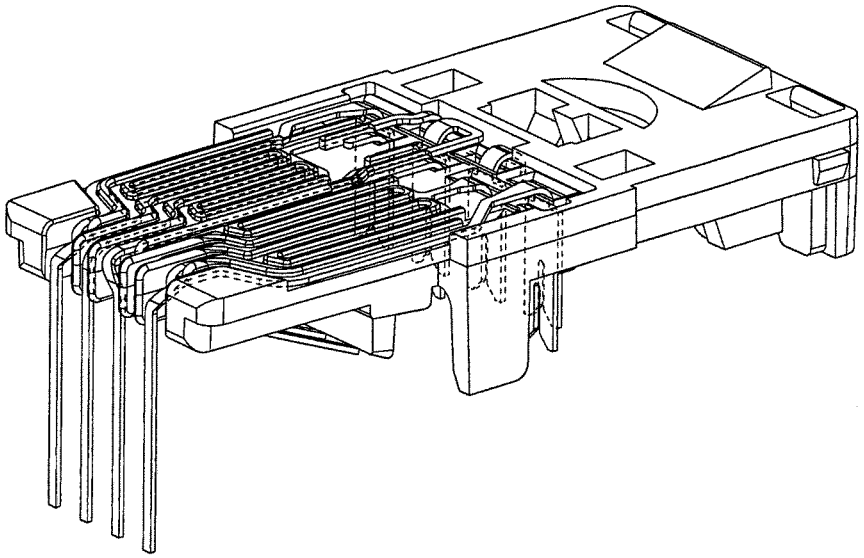
Figure 17:
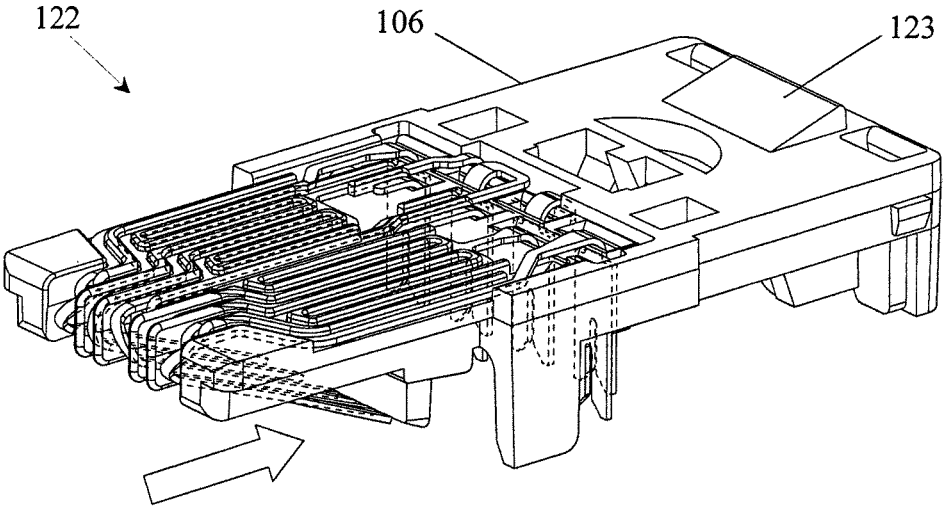
Figure 18:
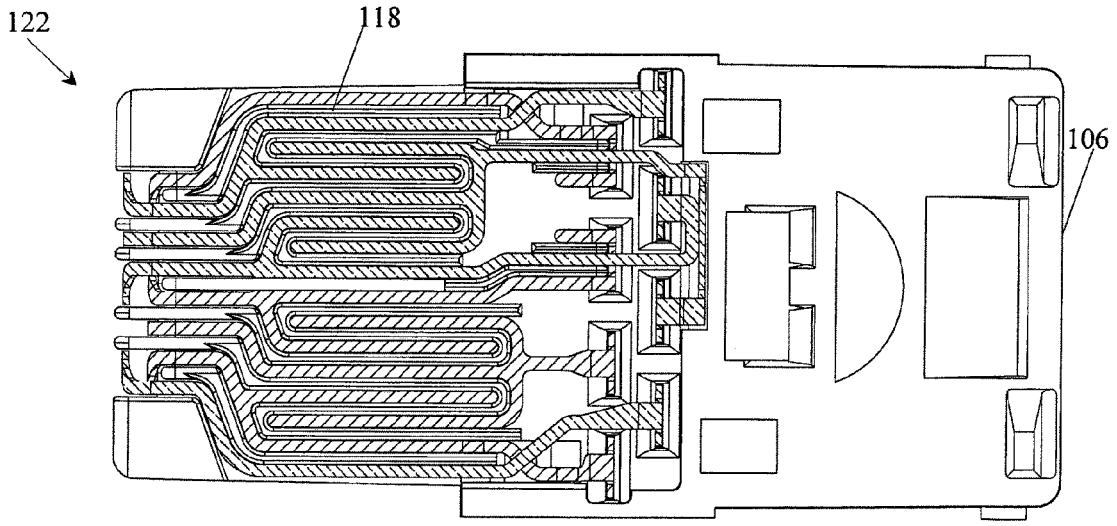
FIG. 18 is a bottom view of contacts and support sled of FIG. 17.
Figure 19:
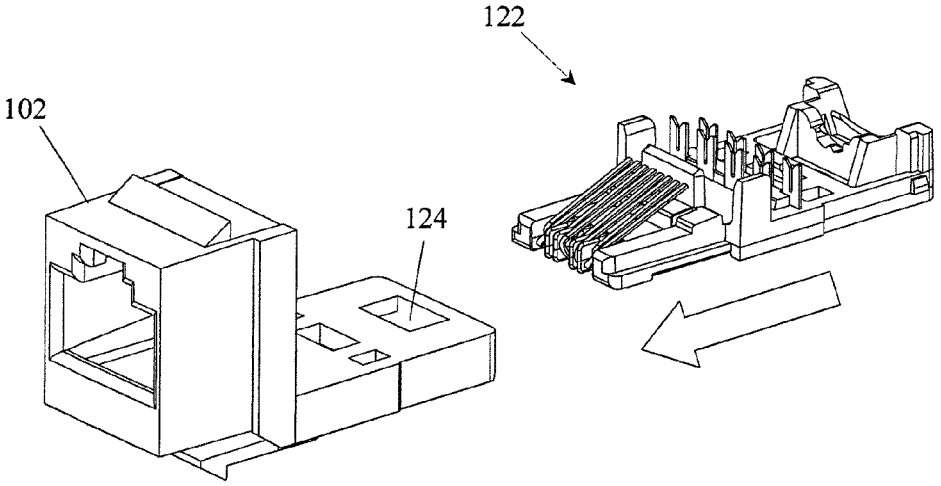
FIG. 19 is a perspective view of an assembly step of the support sled with contacts and the jack housing of FIG. 3.
Figure 20:
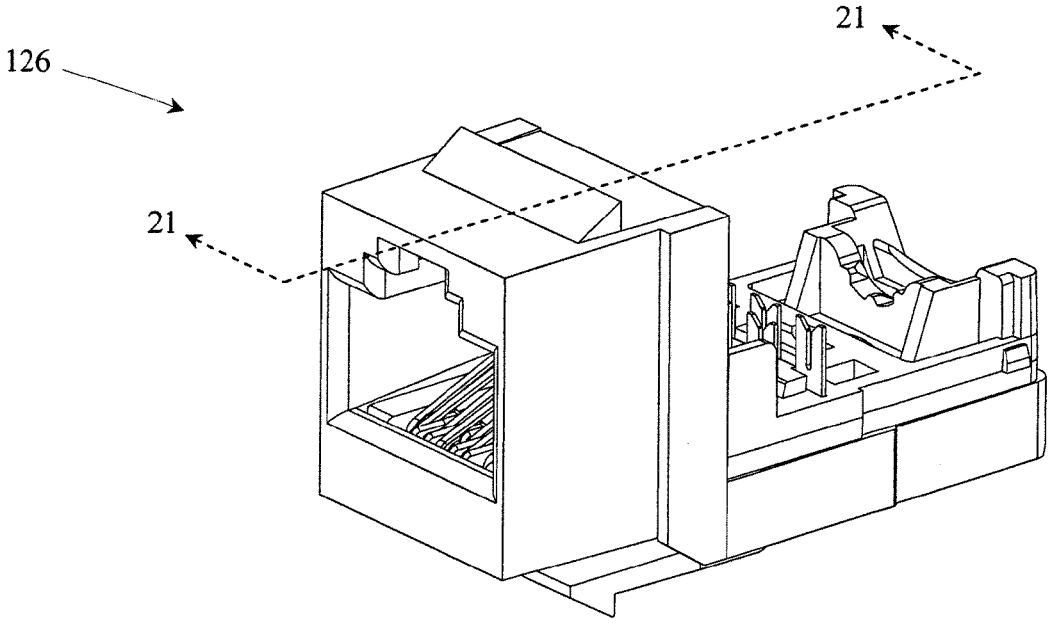
FIG. 20 is a perspective view of a jack subassembly after the assembly step of FIG. 19.
Figure 21:
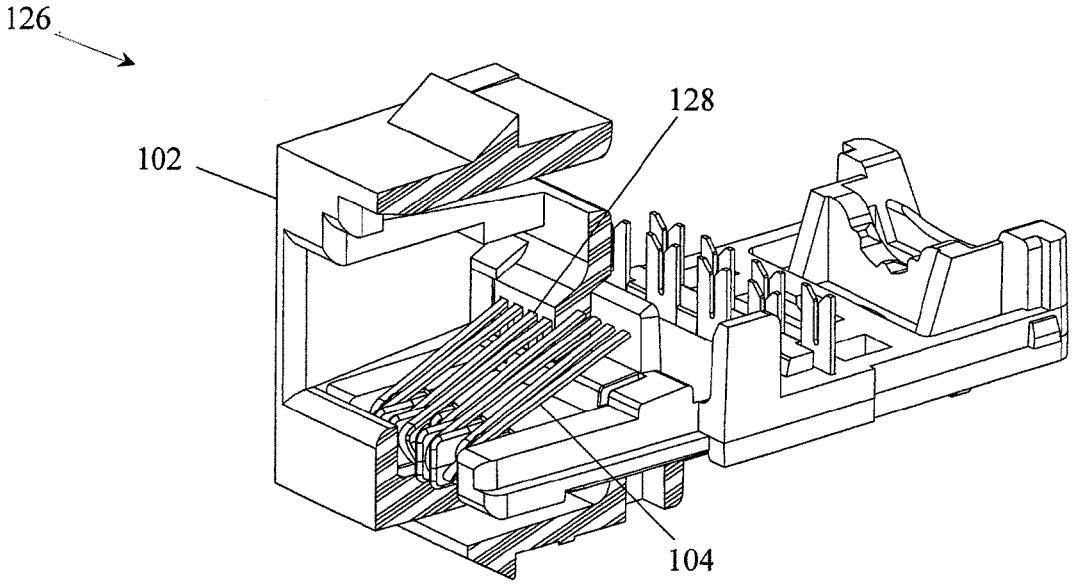
FIG. 21 is a section view taken along section line 21-21 in FIG. 20.

In accordance with an embodiment of the present invention, to assemble communication jack 62, contacts $104_2$, $104_4$, $104_6$, and $104_8$ are placed onto support sled 106 (FIGS. 12 and 13). A forming tool bends contacts 104 around mandrel 120 as shown in FIG. 14. Next, contacts $104_1$, $104_3$, $104_5$, and $104_7$ are placed onto support sled 106 (FIGS. 15 and 16). A forming tool bends contacts 104, as shown in FIG. 17, to create a sled subassembly 122. A bottom view of contacts 104 assembled to sled 106 is shown in FIG. 18. Contacts 104 are shown as crosshatched members to give them contrast against sled 106 and ribs 118, for clarification. Preferably, rib elements 118 exist between all contacts 104 that are sufficiently close to where high potential failures or electrical shorts may be of concern. In a preferred embodiment, contacts 104 of the sled subassembly 122 are constructed using two contact reels. One contact reel contributes contacts $104_1$, $104_3$, $104_5$, and $104_7$ and the other contact reel contributes contacts $104_2$, $104_4$, $104_6$, and $104_8$. Sled subassembly 122 is inserted into housing 102 until latch feature 123 (FIG. 17) of support sled 106 engages pocket 124 to create jack subassembly 126 (FIGS. 20 and 21). A section view of jack subassembly 126 is shown in FIG. 21 to illustrate the relative positioning of contacts 104 within housing 102 as well as to show how the lateral positioning of PICs is controlled by slotted comb elements 128 of housing 102.

Figure 22:
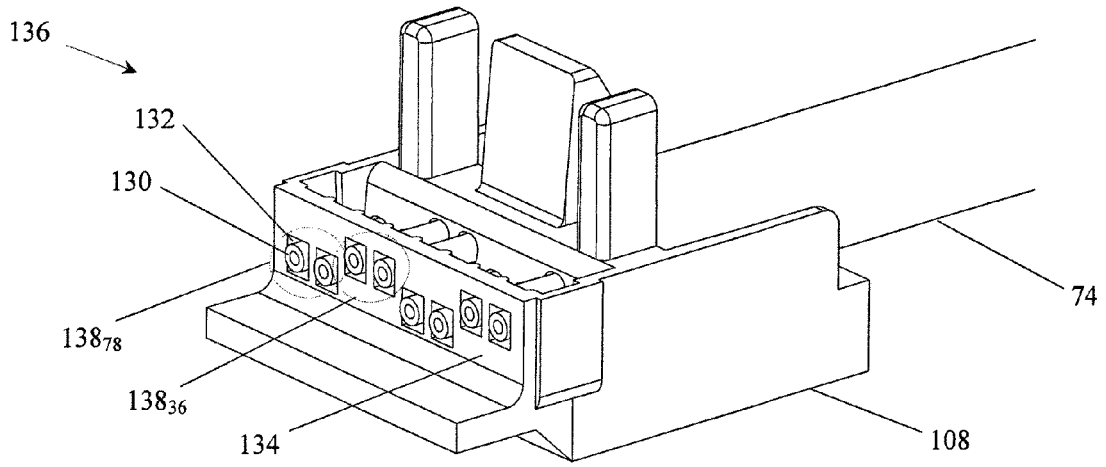
FIG. 22 is a perspective view of the wire cap of FIG. 3 connected to respective cable conductors.
Figure 23:
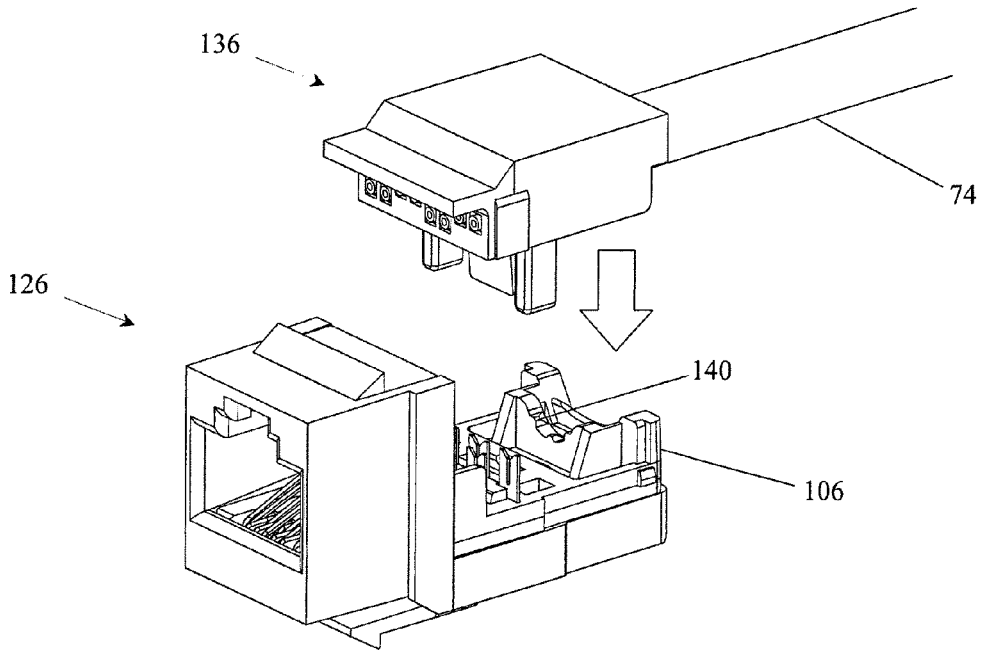
FIG. 23 is a perspective view of an assembly step connecting the wire cap subassembly of FIG. 22 to the jack subassembly of FIG. 20.
Figure 24:
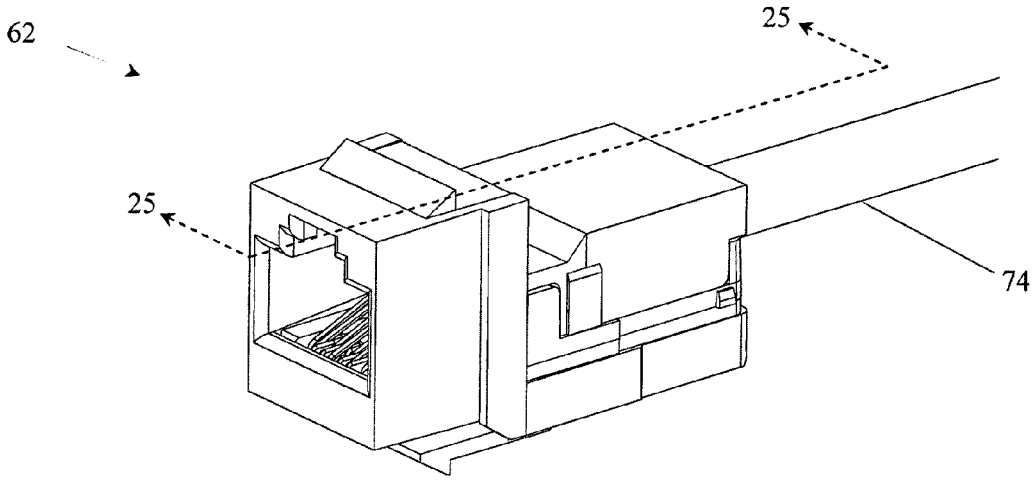
FIG. 24 is a perspective view of the jack according to an embodiment of the present invention after connection to a communication cable, particularly after the wire termination step illustrated in FIG. 23.
Figure 25:
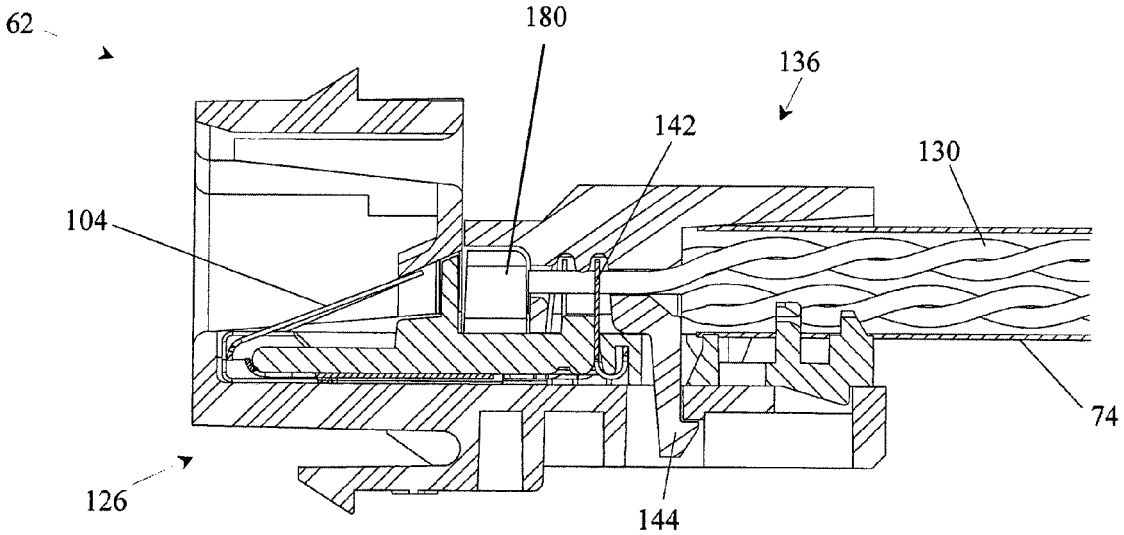
FIG. 25 is a section view taken along section line 25-25 in FIG. 24.

Turning now to FIGS. 22-25, to terminate communication jack 62 to network cable 74 in accordance with one embodiment of the present invention, the first step is orienting wire conductors 130 into their respective apertures 132 of wire cap 108. Conductors 130 are then cut flush to face 134 as shown in FIG. 22 to create a wire cap subassembly 136. Conductor pairs 138 are staggered in wire cap 108 to control the amount of crosstalk created in the wire cap region. For example, conductor pairs $138_{78}$ and $138_{36}$, wherein said conductor pairs correspond to jack contact pairs 7:8 and 3:6, may be offset from each other in a non-collinear manner in order to control the relative amount of crosstalk between these pairs. This holds true for the other adjacent pairs 3:6 to 4:5 and 4:5 to 1:2 in wire cap 108. Wire cap subassembly 136 is then pressed down onto jack subassembly 126 (FIG. 23). Barb features 140 may be integrated into support sled 106 and provide the necessary strain relief for networking cable 74. The completed termination of communication jack 62, according to the described embodiment, is shown in FIGS. 24 and 25. IDCs 142 pierce the insulation of conductors 130 to create an electrical bond between contacts 104 and metal wires of conductors 130. Latch feature 144 of wire cap 108 may be used to secure wire cap subassembly 136 to jack subassembly 126. Conductors 130 can alternatively be trimmed to a predetermined length and extended into gap 180 to improve near end crosstalk performance as required.

Figure 26:
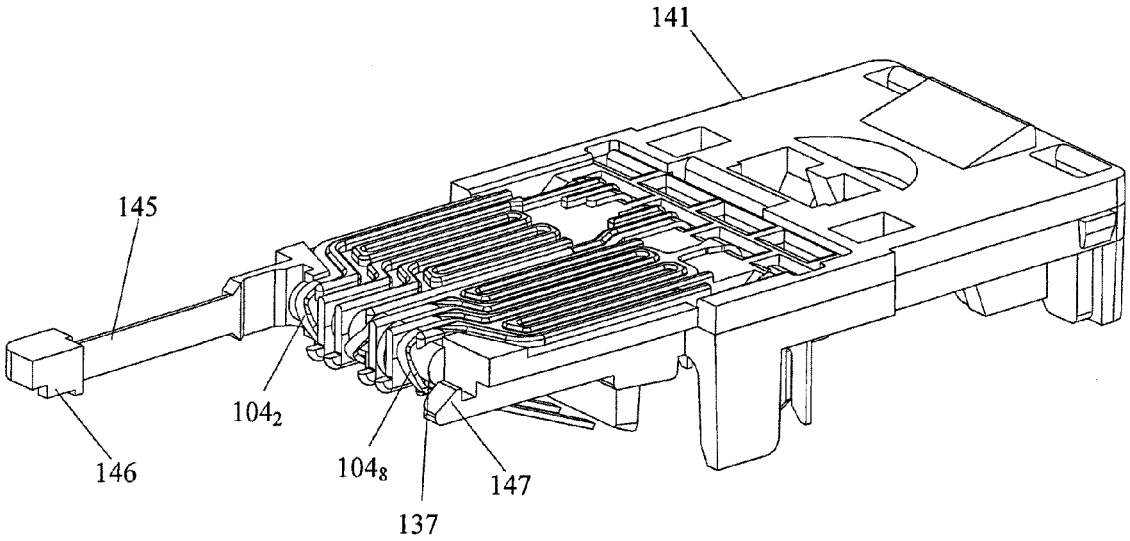
FIG. 26 is a perspective view of the another embodiment of a support sled according to the present invention, with a contact gate in an open state.
Figure 27:
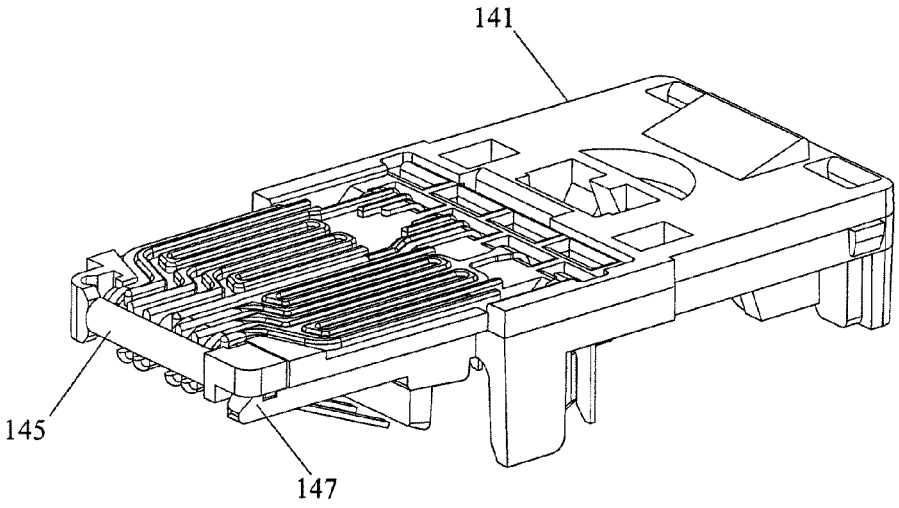
FIG. 27 is a perspective view of the support sled of FIG. 26, with a first set of contacts in place and the contact gate in closed state.
Figure 28:
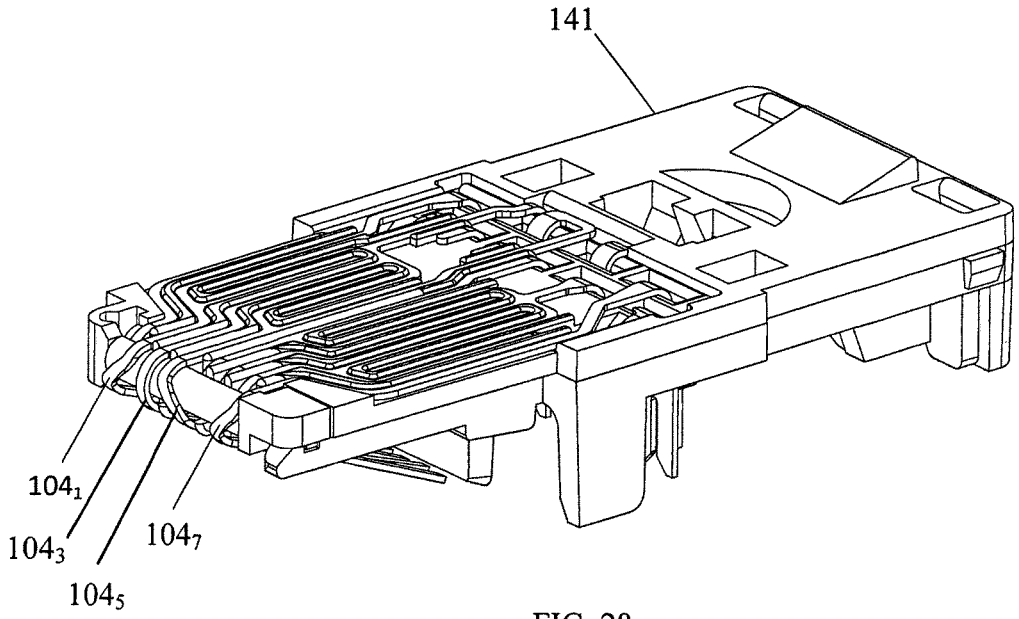
FIG. 28 is a perspective view of the support sled of FIG. 27, with both the first set and second set of contacts in place and the contact gate in closed state.
Figure 29:
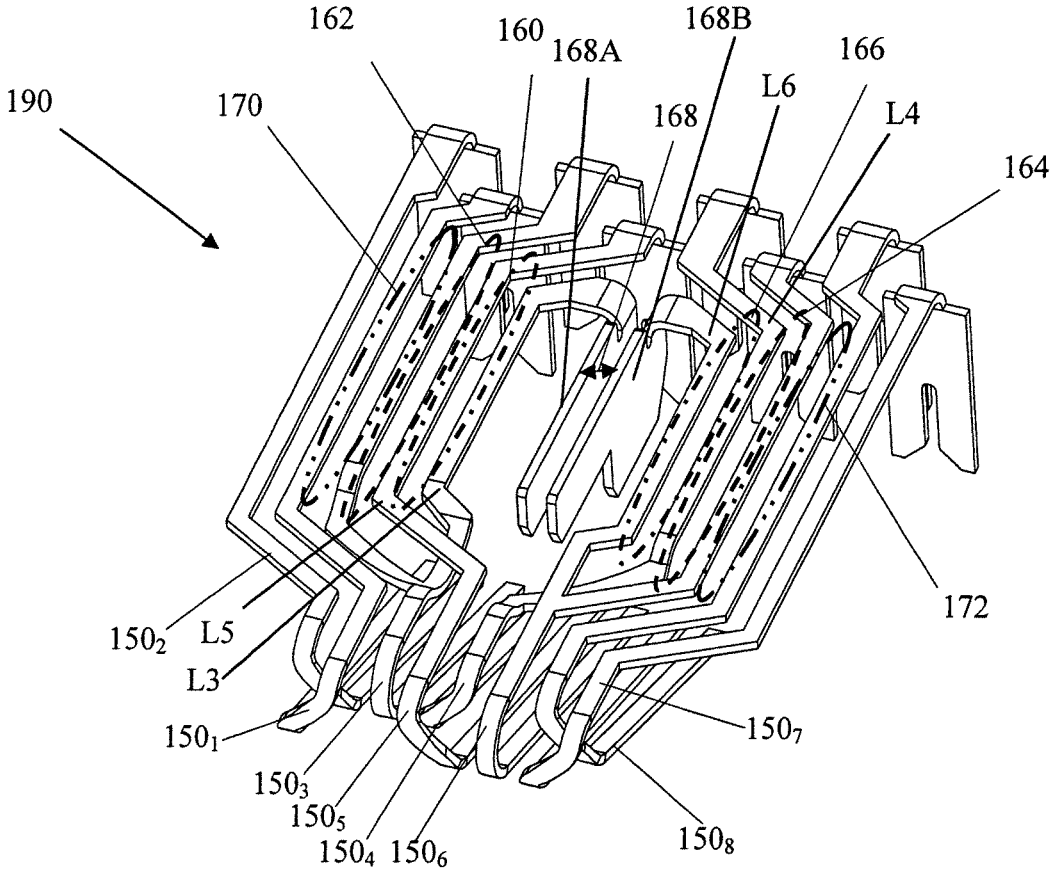
FIG. 29 is a perspective view of the another embodiment of contacts according to the present invention, particularly illustrating an orthogonal compensation network (OCN) in lead frame form.

In an alternate embodiment of the present invention, sled 141 includes a hinging mandrel arm 145, as shown in FIG. 26. To assemble the sled 140 and contacts 104, contacts $104_2$, $104_4$, $104_6$, and $104_8$ are first inserted and bent around the first mandrel 137 of the sled 141 in a similar manner as previously described. Hinging mandrel arm 145 is then closed as shown in FIG. 27. Shelf 146 engages latch 147 to lock hinging mandrel arm 145 in a closed position. Contacts $104_1$, $104_3$, $104_5$, and $104_7$ are then inserted into the sled 140 in a similar manner as previously described, and bent around hinging mandrel arm 145, as shown in FIG. 28. Hinging mandrel arm 145 may improve manufacturability by providing a plastic surface on which to bend contacts $104_1$, $104_3$, $104_5$, and $104_7$. Additionally, adding a substrate between contacts in crossover regions 110 may help reduce the risk of electrical shorts and high potential failures.

Figure 30:
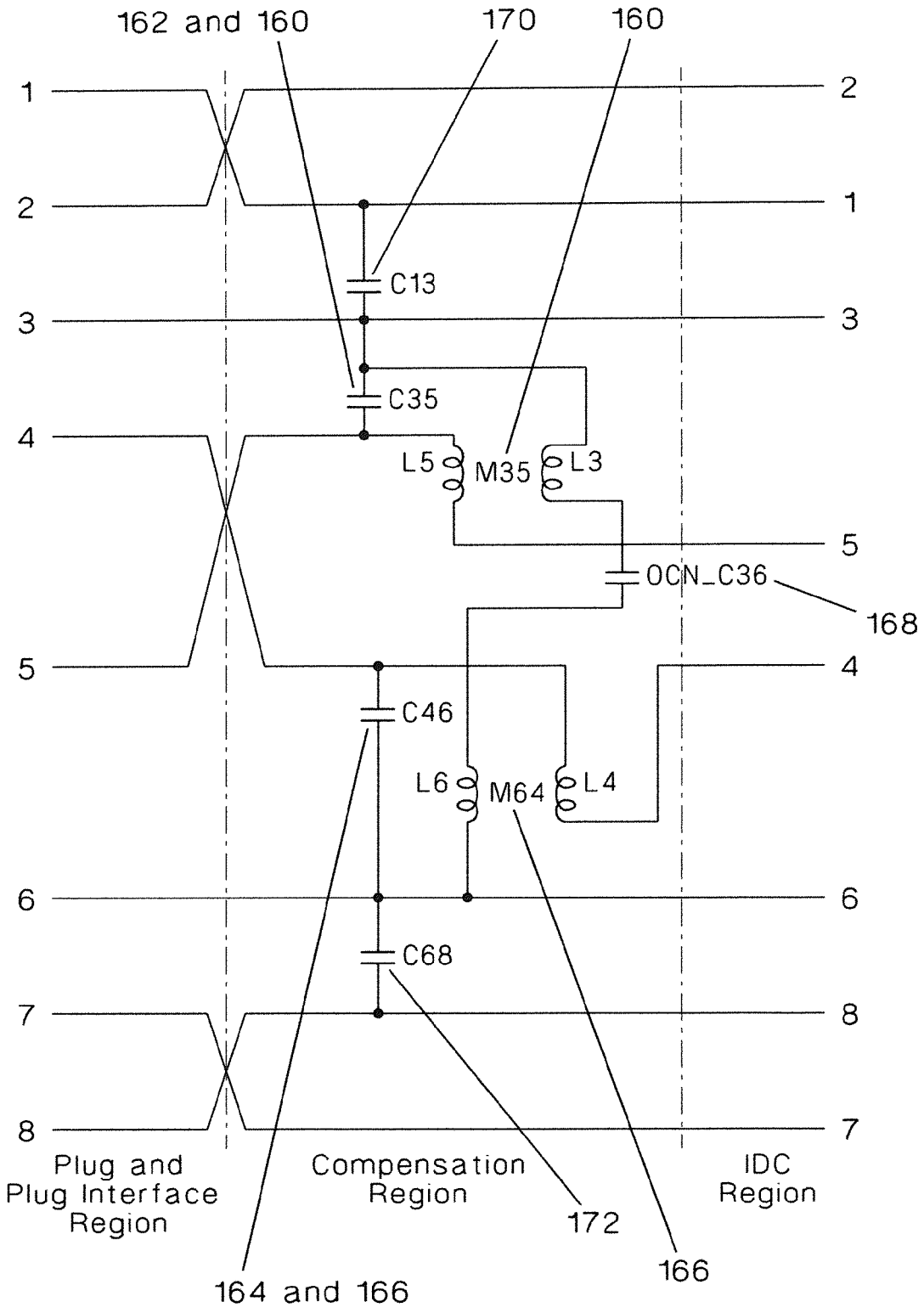
FIG. 30 is a schematic view of the OCN lead frame of FIG. 29.

In yet another embodiment of the present invention, contacts 190 employ a crosstalk compensation technique (OCN technique) disclosed in U.S. Patent Application Ser. No. 61/563,079, entitled "Single Stage Compensation Network for RJ45 Jacks Using an Orthogonal Compensation Network," filed on Nov. 23, 2011, and incorporated herein by reference in its entirety. Contacts 190 are represented by the schematic shown in FIG. 30. The near end crosstalk compensation according to the currently described embodiment is particularly shown for the 3:6-4:5 contact pair combination. The approximate 180 degrees out of phase compensation (with respect to the plug crosstalk) can be achieved with distributed compensation capacitance for 3:6-4:5 contact pairs. This compensation occurs along the coupled lengths of the compensation zones in four areas 160, 162, 164 and 166, corresponding schematically to C35 and C46 (which are shown on FIG. 30 as discrete capacitors, but are in fact distributed elements as indicated). Elements 160 and 162 include distributed capacitance between contacts $150_3$ and $150_5$ along the length of the compensation zone (from the nose's crossover to the IDC region), while 164 and 166 include distributed capacitance between contacts $150_4$ and $150_6$. The mutual inductance between contacts $150_4$ and $150_6$ is mainly from the coupled element 166 (between self inductances L4 and L6 corresponding to self inductances of contacts $104_4$ and $104_6$, respectively) and the mutual inductance between contacts $150_3$ and $150_5$ is mainly from the coupled element 160 (mutual inductance between L3 and L5 corresponding to self inductances of contacts $104_3$ and $104_5$, respectively). The mutual inductances 160 and 166 are coupled with capacitor 168 (the capacitance between contacts $150_3$ and $150_6$, particularly between plates 168A and 168B) to create a compensation vector at the same stage, or position, as a separate compensation vector produced by the capacitive coupling C35 and C46. Contacts $150_3$ and $150_6$ are contacts from the same differential conductor pair. The two compensating signals (vectors) effectively couple to produce single-stage compensation. The remaining conductor pairs $150_1$ and $150_3$ and $150_6$ and $150_8$, have distributed compensation capacitance 170 (C13) and 172 (C68), respectively, for NEXT tuning for pair combinations 1:2-3:6 and 3:6-7:8. Other components of a jack such as, but not limited to, a housing, a sled, and a wire cap can be modified to suitably conform to the contact set 190 for embodiments which employs said contact set. Additionally, the OCN technique can be applied to other pair combinations as desired.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A method of assembling a lead frame communication connector, comprising the steps of:

attaching a plurality of conductors to a dieletric sled wherein said plurality of conductors are arranged in respective communication pairs, each of said plurality of conductors having a plug contact region and an opposing cable conductor termination region;

further wherein the plurality of conductors have at least one first conductive finger connected to a first one of said conductors of a first one of said communication pairs and at least one second conductive finger connected to a second one of said conductors of a second one of said communication pairs such that said at least one first conductive finger is interlaced with said at least one second conductive finger;

and wherein said at least one first conductive finger is separated from said at least one second conductive finger with respective ribs of said dielectric sled.

2. The method of claim 1, wherein said at least one first conductive finger interlacing with said at least one second conductive finger capacitively couples said at least one first conductive finger with said at least one second conductive finger.

3. The method of claim 1, further including the step of staggering cable conductor apertures in a wirecap of the communication connector.

4. The method of claim 1, further including the step of trimming cable conductors to a predetermined length to improve near end crosstalk performance.

5. The method of claim 4, further including the step of extending said cable conductors into a gap between a wirecap and at least one of a dielectric sled and a connector housing.

* * * * *